US006290373B1

(12) United States Patent
Dwight et al.

(10) Patent No.: US 6,290,373 B1
(45) Date of Patent: Sep. 18, 2001

(54) LIGHT FIXTURE WITH MOVABLE BULB CARRIAGE

(75) Inventors: Brian Dwight, Woodville; David Dwight, Pickering, both of (CA)

(73) Assignee: Dwight Crane Rentals Ltd. (CA)

( * ) Notice: Subject to any disclaimer, the term of this patent is extended or adjusted under 35 U.S.C. 154(b) by 0 days.

(21) Appl. No.: 08/975,909

(22) Filed: Nov. 21, 1997

(51) Int. Cl.[7] ..... F21V 7/22

(52) U.S. Cl. ..... 362/285; 362/289; 362/306

(58) Field of Search ..... 362/286, 272, 362/273, 280, 289, 372, 371, 427, 428, 306; 248/128, 429, 313, 510

(56) References Cited

U.S. PATENT DOCUMENTS

| | | | | |
|---|---|---|---|---|
| Re. 30,000 | | 5/1979 | Loffler et al. | 362/233 |
| 1,313,739 | | 8/1919 | Ryerson . | |
| 1,512,158 | * | 10/1924 | Bragg et al. | 362/286 |
| 2,109,056 | | 2/1938 | Bardwell et al. . | |
| 2,295,031 | | 9/1942 | Davis . | |
| 2,510,892 | | 6/1950 | Kennelly . | |
| 2,663,792 | | 12/1953 | Gretener . | |
| 2,750,155 | | 6/1956 | Nixon . | |
| 2,819,385 | | 1/1958 | Smith . | |
| 2,911,518 | | 11/1959 | Anderson . | |
| 3,049,615 | | 8/1962 | Sawyer . | |
| 3,656,287 | | 4/1972 | Morrison et al. | 56/328 |
| 3,703,635 | | 11/1972 | Burkarth | 240/44.1 |
| 3,720,822 | | 3/1973 | Rochester et al. | 240/1.3 |
| 3,758,769 | | 9/1973 | Pichel | 240/41 |
| 3,949,218 | | 4/1976 | Hayward | 240/67 |
| 3,957,124 | | 5/1976 | Desourdy | 173/28 |
| 3,982,715 | | 9/1976 | Lindgren et al. | 248/2 |
| 4,072,856 | | 2/1978 | Eligehausen | 362/2 |
| 4,190,117 | | 2/1980 | MacLean | 173/43 |
| 4,220,981 | | 9/1980 | Koether | 362/61 |
| 4,229,781 | | 10/1980 | Hitora | 362/274 |
| 4,234,914 | | 11/1980 | Boesen | 362/240 |
| 4,264,051 | | 4/1981 | Walmsley et al. | 248/660 |
| 4,298,911 | | 11/1981 | Headrick | 362/35 |
| 4,392,187 | | 7/1983 | Bornhorst | 362/233 |
| 4,423,469 | | 12/1983 | Zerlaut et al. | 362/2 |
| 4,423,471 | | 12/1983 | Gordin et al. | 362/96 |
| 4,450,507 | | 5/1984 | Gordin | 362/61 |
| 4,598,345 | | 7/1986 | Kleeman | 362/233 |
| 4,602,321 | | 7/1986 | Bornhorst | 362/268 |
| 4,712,167 | | 12/1987 | Gordin et al. | 362/233 |
| 4,729,077 | * | 3/1988 | Gordin et al. | 362/285 |
| 4,779,168 | | 10/1988 | Montgomery | 362/66 |
| 5,207,747 | | 5/1993 | Gordin et al. | 362/233 |
| 5,273,242 | * | 12/1993 | Mouri et al. | 248/429 |
| 5,313,378 | | 5/1994 | Gordin et al. | 362/226 |

FOREIGN PATENT DOCUMENTS

| | | | |
|---|---|---|---|
| 2060585 | 2/1992 | (CA) | F21V/29/00 |
| 16225 | 7/1912 | (GB) . | |
| 395017 | 1/1932 | (GB) | 524/32 |

* cited by examiner

*Primary Examiner*—Sandra O'Shea
*Assistant Examiner*—Ismael Negron
(74) *Attorney, Agent, or Firm*—Duane, Morris & Heckscher LLP

(57) ABSTRACT

A light fixture which is adapted to accommodate either tungsten filament and gas discharge light bulbs in an adjustable carriage to permit an operator to adjust the focus of the light and to switch bulbs to illuminate a scene, such as the scene of a motion picture film, with different lighting effects. The light fixture has a reflector to reflect light to illuminate a scene, a socket to receive and to hold either a tungsten filament bulb or a gas discharge bulb, a power source to provide electrical power to the socket to illuminate either a gas discharge or tungsten filament bulb, a carriage holding the socket in a position where a light bulb in a socket will extend forwardly of the reflector, with the carriage being mounted on tracks to slide linearly back and forth with respect to the reflector, a drive means under the control of an operator to move the carriage through a range of linear motion, and an adjustable connector linking the drive means to the carriage to permit an operator to adjust the position of the range of motion of the carriage to accommodate different types of bulbs.

10 Claims, 3 Drawing Sheets

LIGHT FIXTURE WITH MOVABLE BULB CARRIAGE

BACKGROUND OF THE INVENTION (a) Field of Art

This invention relates to a light fixture which is adapted to accommodate either tungsten filament and gas discharge light bulbs in an adjustable carriage to permit an operator to adjust the focus of the light and to switch bulbs to illuminate a scene, such as the scene of a motion picture film, with different lighting effects.

(b) Prior Art

It is known in the prior art to use both tungsten filament and gas discharge lights to illuminate large areas with either spot or flood lighting. It is also known that tungsten filament bulbs and gas discharge bulbs emit light of different temperature which create different lighting effects. It is within the ordinary skill of a person who constructs light fixtures to make a socket to receive and power both a tungsten filament bulb or a gas discharge bulb.

It is known that light fixtures may be constructed to permit a light bulb to move with respect to a parabolic light reflector to adjust the focus of the light. In this manner one may adjust between spot and flood lighting. One way of focussing a light has a carriage that supports a socket and a bulb to move a bulb linearly with respect to the reflector. This type of mechanism has been used with either gas discharge and tungsten filament light bulbs, but no one such mechanism has been developed for use with both types of bulbs.

Instead, the common practice is that tungsten filament lights are mounted in one type of fixture and gas discharge bulbs are mounted in a different type of fixture and the fixtures are interchanged from time to time while illuminating a scene as is appropriate to the lighting requirement. Specific fixtures have been developed for tungsten filament and gas discharge bulbs, in part, because the source of the light in a tungsten filament bulb is at a different linear position than it would be found in a gas discharge bulb; thus each type of bulb has a different longitudinal range of focus with respect to a reflector in a fixture. Consequently, an operator would have difficulty controlling a servo mechanism to change from spot to flood lighting as bulbs were changed, because the carriage would have to be controlled within different ranges.

The capital cost of having special light fixtures for each type of light bulb may be reduced with the present invention.

GENERAL DESCRIPTION OF THE INVENTION

It is an object of the present invention to provide a light fixture having a focusing apparatus which may be used for either gas discharge or tungsten filament bulbs.

The present invention is a light fixture comprising a reflector to reflect light to illuminate a scene; a socket to receive and to hold either a tungsten filament bulb or a gas discharge bulb; a power source to provide electrical power to said socket to illuminate either a gas discharge or tungsten filament bulb; a carriage holding said socket in a position where a light bulb in the socket will extend forwardly of said reflector, said carriage being mounted on tracks to slide linearly back and forth with respect to said reflector; a drive means under the control of an operator to move the carriage through a range of linear motion; an adjustable connector linking the drive means to the carriage to permit an operator to adjust the position of the range of motion of the carriage to accommodate different types of bulbs.

The socket is mounted in a carriage which in turn is mounted to slide upon tracks and to permit the bulb to move linearly to and fro with respect to the reflector to adjust the light emanating from the light fixture between spot and flood lighting. The tracks are mounted between a rear wall and a front wall of a box which surrounds and protects the carriage. The light bulb extends through a hole in the front wall forwardly of a base of the reflector and guide means, comprising springs extending from a ring surround the bulb to help support it in the socket as the carriage moves.

In a preferred embodiment disclosed hereafter the drive means comprises a servo mechanism actuator, an arm extending from said actuator to a crank handle, a crank shaft extending through a side wall of the box enclosing the carriage, a radial arm connected to rotate in response to movement of the crank shaft, a rod connected to a distal end of said radial arm connected to an adjustable connector on the carriage. It will be obvious to one skilled in the art that other linkages between an actuator and the adjustable connector on the carriage would be possible without departing from the invention. For example, a more direct linkage could be established to eliminate some elements or some of the elements could be replaced with flexible or coiled wire elements.

In a preferred embodiment disclosed hereafter the adjustable connector comprises a pair of flanges extending outwardly from the carriage, a threaded shaft mounted to turn between said flanges in a non-threaded connection, a threaded block mounted in a threaded connection on said shaft and a lug on said block connected to the dive means; said threaded shaft being capped by a head to receive a screwdriver to permit to turn the threaded shaft to adjust the position of block between the said flanges thus altering the range of motion of the carriage in response to the drive means. Again the particular construction of this embodiment might be altered in ways obvious to one skilled in the art without departing from the principle of this invention. For example, the threaded shaft could be replaced by any mechanical equivalent that would obtain the function of permitting a linear change in the relationship of the connector to the drive means such as a stepped rod that would engage at different positions located on the carriage.

DESCRIPTION OF THE PREFERRED EMBODIMENT (a) Description of the Figures

The following figures illustrate a preferred embodiment of this invention:

DESCRIPTION OF THE PREFERRED EMBODIMENT

Figure 1:
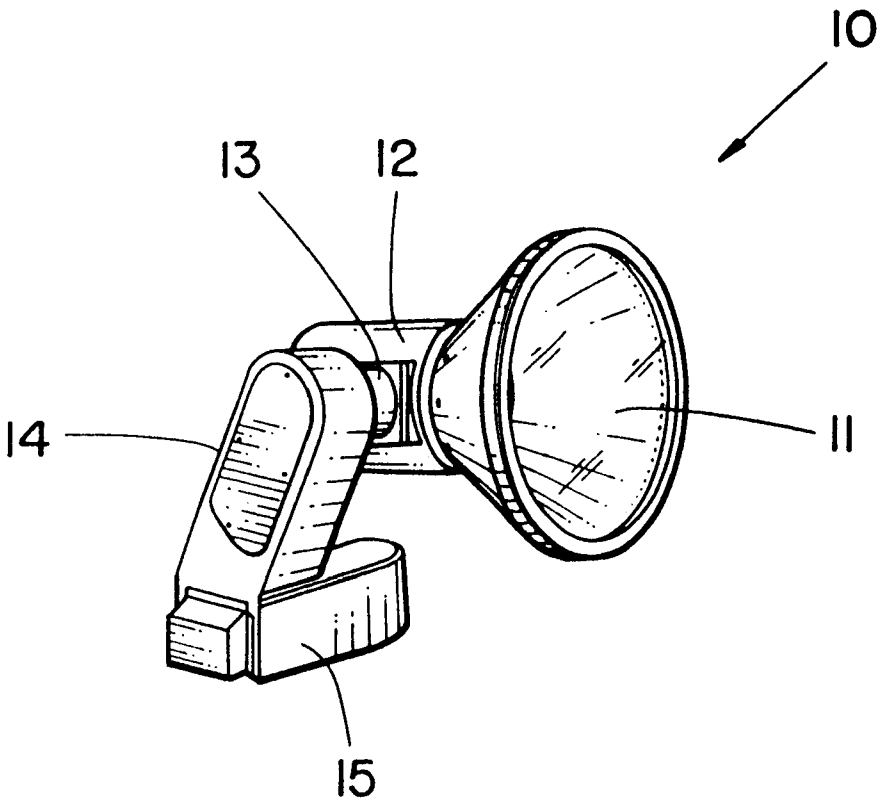
FIG. 1 is a schematic illustration of a light fixture.

FIG. 1 illustrates a typical light fixture {10} having a light reflector {11} mounted on a first arm {12} to pivot about pin {13} mounted in a second arm {14} extending from a footing {15}. Footing {15} may be mounted in any appropriate supporting mechanism in a conventional manner. The adjustment of the light to point in an appropriate direction by means of arms {12, 14} and pin {13} is within the state of the art.

Figure 2:
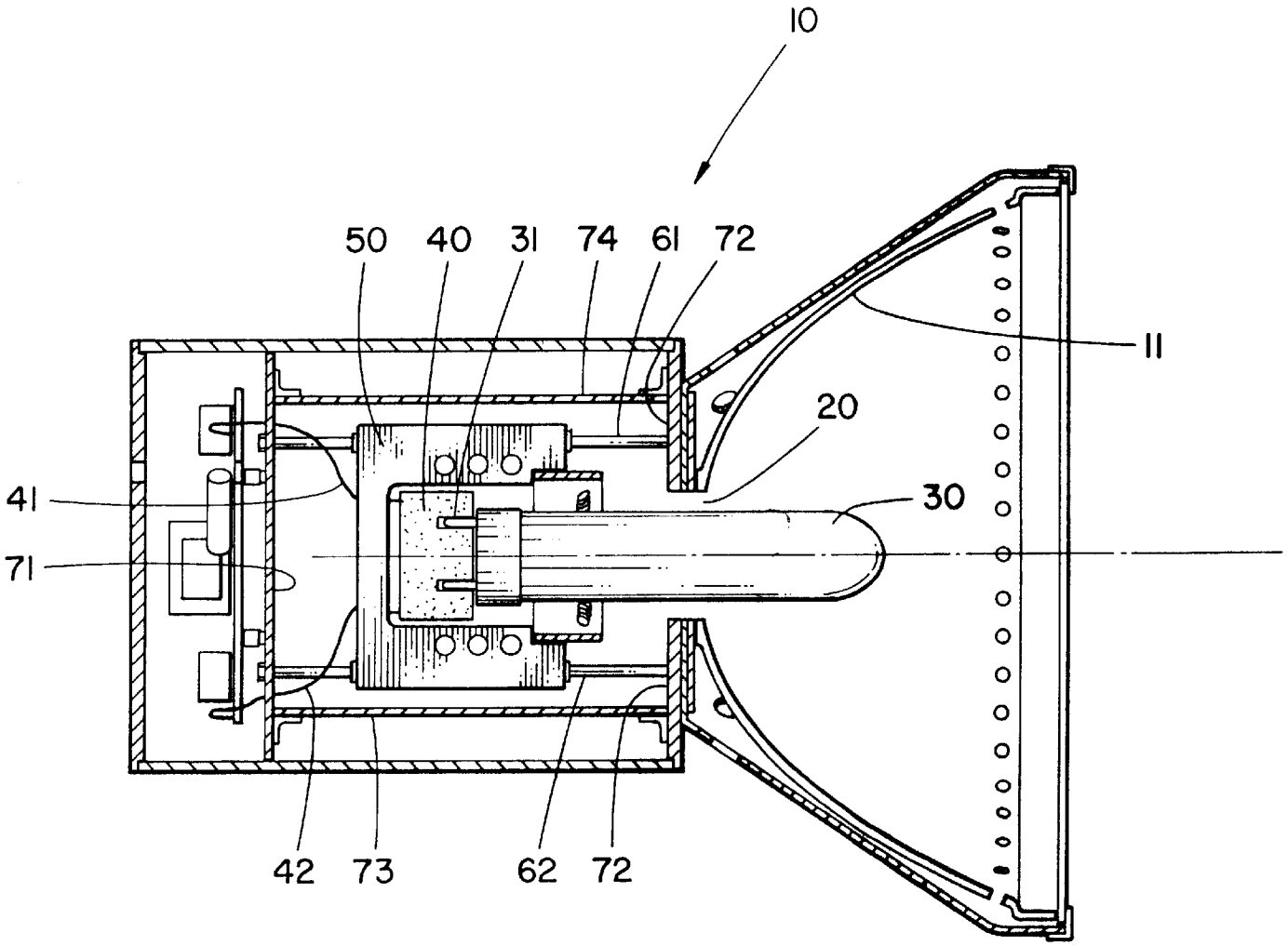
FIG. 2 is a cross-section of the light fixture of FIG. 1 illustrating the sliding carriage and light bulb.

FIG. 2 illustrates that the parabolic light reflector {11} has an opening {20} near its center through which extends a light bulb {30}. The bulb {30} has prongs {31} inserted in a socket {40}. The light socket {40} contains contacts (not shown) which are electrically powered by wires {41} and {42} (further and other wires may be used as may be appropriate for particular bulbs). The contacts connect with the prongs {31} of a bulb {30} to illuminate it.

The socket {40} is mounted in a carriage {50} which in turn is mounted to slide upon tracks {61} and {62} to permit the light bulb {30} to move linearly to and fro with respect to the reflector {11}. By this means the focus of the light emanating from the light fixture {10} may be adjusted between spot and flood lighting. The tracks {61} and {62} are mounted between a rear wall {71} and a front wall {72} of a box {70} also including a bottom wall {73}, a top wall {74} and side walls {75} and {76}. which surrounds and protects the carriage {50} (see also FIG. 3).

Figure 3:
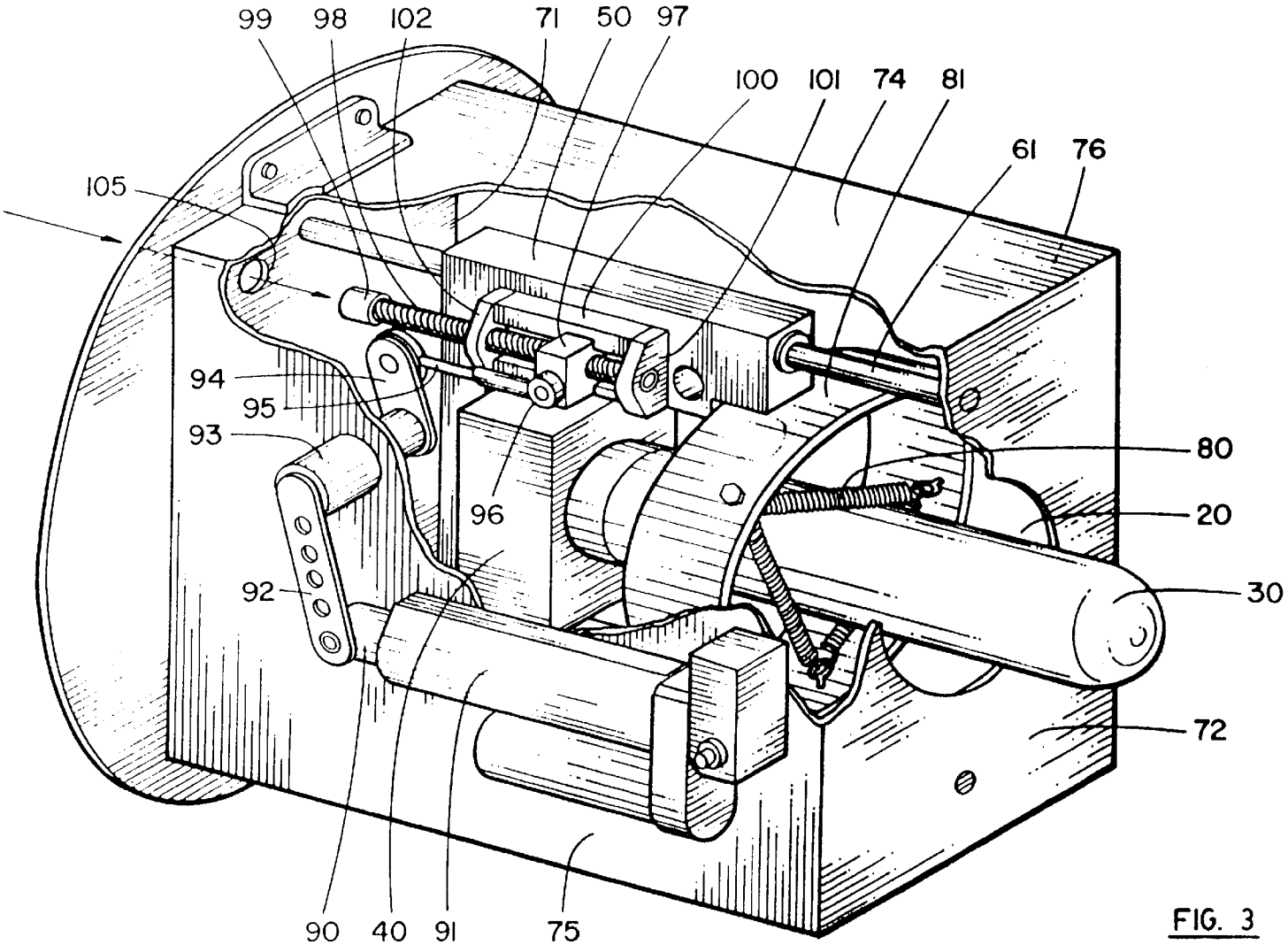
FIG. 3 is a further detail of the light fixture in FIGS. 1 and 2 illustrating the adjustable connector of this invention.

FIG. 3 illustrates the mechanism for controlling the movement of the carriage {50} with respect to the reflector {11}. The light bulb {30} extends through the hole {20} in front wall {72} from which it extends forwardly of the base of the reflector {11} (See also FIG. 2). Guide means, which in this embodiment comprise springs {80} that extend from a ring {81}, surround the bulb {30} and help support it in the socket {40} it as the carriage {50} moves to and fro. An arm {90} extends from an actuator cylinder {91} of a servo mechanism drive means to manipulate crank handle {92} to and fro in response to a control (not shown) actuated by an operator. As the crank handle {92} moves it turns shaft {93} which extends through side wall {75} of the box {70} to move radial arm {94}. A rod {95} on the distal end of radial arm {94} then drives the carriage {50} by means of its connection to a lug {96} of an adjustable connector {100} affixed to the side of the carriage {50}.

The connector {100} a pair of flanges {101} and {102} extending outwardly from the carriage {50}, a threaded shaft {98} mounted to turn between said flanges {101} and {102}, a threaded block {97} mounted on said shaft {98} and a lug {96} on said block {97}. The threaded shaft {98} is mounted to turn in non-threaded connection within flanges {101} and {102}, but extends through block {97} in a threaded connection. It continues outside the flange {102} a short distance towards the rear wall {71}. The threaded shaft {98} is capped by an adjustment mechanism {99}, for example as a head to receive a screwdriver. The rear wall {71} has a hole {105} to permit an adjustment means, such as a screwdriver, to be inserted to turn the cap {99} and the threaded shaft {98} to adjust the position of block {97} within the range between flanges {101} and {102}.

In operation the power arm {90} may be activated by a servo mechanism to turn crank handle {92}, shaft {93}, radial arm {94} to drive rod {95} and block {97} to apply force through the threaded shaft {98} to flanges {101} and {102} of the adjustable connector {100} to direct the force onto carriage {50} to cause it to slide either to or fro along the tracks {61} and {62} thus permitting adjustment of the light bulb {30} with respect to the reflector {11} for the purpose of adjusting light focus. An operator may adjust the position of block {97} with respect to the carriage {50} to select different ranges for the linear to and fro motion of the carriage {50} and the light bulb {30}. Thus, an operator may use different types of light bulbs with light sources at different linear positions and still be able to use the same fixture to obtain the required spot or flood lighting effects .

The description of the preferred embodiment of this invention is intended to be illustrative rather than limiting. The full scope of the invention may be obtained from consideration of the whole of this specification including the claims which follow.

We claim:

1. A light fixture comprising:

a reflector to reflect light to illuminate a scene;

a socket to receive and hold a light bulb;

a power source to provide electrical power to said socket to illuminate the light bulb;

a carriage holding said socket in a position where said light bulb will extend forwardly of said reflector, said carriage being mounted on tracks to slide linearly back and forth with respect to said reflector;

a drive means to move the carriage through a range of linear motion;

a transfer mechanism coupled between the drive means and the carriage for translating movements of the drive means into a linear motion of the carriage; and, an adjustable connector linking the transfer mechanism to the carriage to permit adjustment of the range of linear motion of the carriage to accommodate different types of bulbs.

2. The light fixture of claim 1, wherein the carriage is mounted to slide upon tracks to permit the bulb to move linearly with respect to the reflector to adjust the light emanating from the light fixture.

3. The light fixture of claim 2 in which the tracks are mounted between a rear wall and a front wall of a box which surrounds and protects the carriage.

4. The light fixture of claim 3, wherein the light bulb extends through a hole in a the front wall forwardly of a base of the reflector and a guide means, said guide means comprising springs extending from a ring surrounding the bulb to help support the bulb in the socket as the carriage moves.

5. The light fixture of claim 2, wherein the light emanating from the light fixture is adjusted between spot lighting and flood lighting.

6. The light fixture of claim 1, wherein the drive means comprises:

a servo mechanism actuator;

an arm extending from said actuator to a crank handle;

a crank shaft extending through a side wall of a box enclosing the carriage;

a radial arm connected to rotate in response to movement of the crank shaft; and, a rod connected to a distal end of said radial arm, said connected to the adjustable connector.

7. The light fixture of claims 1 or 6, wherein the adjustable connector comprises:

a pair of flanges extending outwardly from the carriage;

a threaded shaft mounted to turn between said flanges in a non-threaded connection;

a threaded block mounted in a threaded connection on said shaft; and, a lug on said block connected to the drive means;

said threaded shaft being capped by a head to receive a screwdriver to permit turning of the threaded shaft to adjust the position of the block between said flanges, thus altering the range of motion of the carriage in response to the drive means.

8. The light fixture of claim 1, wherein the light bulb is selected from a group consisting of gas discharge and tungsten filament bulbs.

9. The light fixture of claim 1, wherein the transfer mechanism comprises:

a first arm coupling the drive means to a crank handle;

a crank shaft coupling the crank handle to radial arm; and, a rod coupling the radial arm to a lug of the adjustable connector.

10. A light fixture comprising:

a reflector to reflect light from a selected light bulb to illuminate a scene;

a socket to receive and hold the selected light bulb;

a power source to provide electrical power to said socket to illuminate the selected light bulb;

a carriage holding said socket in a position where the selected light bulb extends forwardly of the reflector, said carriage being mounted on the light fixture to slide linearly back and forth through a first range of linear motion to define a longitudinal range of focus with respect to the reflector for light emanating from the light fixture for the selected light bulb;

a drive means to move the carriage through the range of linear motion; and, an adjustable connector linking the drive means to the carriage to move the carriage through a second range of linear motion to permit adjustment of the longitudinal range of focus with respect to the reflector to accommodate different types of light bulbs.

* * * * *